US007690956B2

(12) United States Patent
Ito et al.

(10) Patent No.: US 7,690,956 B2
(45) Date of Patent: Apr. 6, 2010

(54) SHIFT MOTION CONTROL DEVICE

(75) Inventors: Makoto Ito, Shizuoka (JP); Takuya Kado, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 16 days.

(21) Appl. No.: 12/258,517

(22) Filed: Oct. 27, 2008

(65) Prior Publication Data

US 2009/0124141 A1 May 14, 2009

(30) Foreign Application Priority Data

Nov. 13, 2007 (JP) ..... 2007-294198

(51) Int. Cl.
*B63H 23/00* (2006.01)

(52) U.S. Cl. ..... 440/1; 440/86

(58) Field of Classification Search ..... 440/1, 440/84, 86; 701/21

See application file for complete search history.

(56) References Cited

U.S. PATENT DOCUMENTS 5,230,643 A * 7/1993 Kanno ..... 440/86
7,442,102 B2 * 10/2008 Ito et al. ..... 440/1
2003/0054704 A1 * 3/2003 Kanno ..... 440/1

FOREIGN PATENT DOCUMENTS

JP 2001-152897 A 6/2001

* cited by examiner

*Primary Examiner*—Lars A Olson
(74) *Attorney, Agent, or Firm*—Keating & Bennett, LLP

(57) ABSTRACT

A shift-in operation determination device determines a shift-in operation based on a signal in accordance with an operation of a remote control lever. An ignition timing operation device retards an ignition timing of an engine based on a determination result of the shift-in operation by the shift-in operation determination device. A shift-in command device engages a shift actuator and a dog clutch with either of a forward traveling bevel gear or a rearward traveling bevel gear in a state where the ignition timing of the engine is retarded. The shift-in operation determination device works to prevent a shock which occurs at a shift-in while maintaining a stable engine output in an outboard motor.

11 Claims, 6 Drawing Sheets

SHIFT MOTION CONTROL DEVICE

BACKGROUND OF THE INVENTION

1. Field of the Invention

The present invention relates to a shift motion control device, and more specifically, to a shift motion control device suitable to prevent a shock from occurring at a time of a shift-in of an electrical shift of an outboard motor.

2. Description of the Related Art

In some shift mechanisms for switching the transmission of power of an outboard motor between forward traveling and rearward traveling, a dog clutch has been used. Using the dog clutch, rotational force of a drive shaft can be transmitted to a propeller shaft by engaging the dog clutch, which is stationary along with the propeller shaft, with a gear that is rotating along with the drive shaft at shift-in.

Also, JP-A-2001-152897, for example, discloses a method for reducing the engine speed when movement of a shift lever out of a neutral position is detected while an engine is idling, in order to prevent the shock generated at shift-in.

In the method disclosed in JP-A-2001-152897, engine speed is reduced when the shift lever is moved out of the neutral position. However, this method also results in the engine speed being occasionally reduced while shift-in is not performed. Thus, an output of the engine becomes unstable.

SUMMARY OF THE INVENTION

In order to overcome the problems describe above, preferred embodiments of the present invention provides a shift motion control device that can prevent the occurrence of a shock at a time of shift-in while maintaining a stable level of engine output.

A preferred embodiment of the present invention includes a lever position detection device arranged to detect a position of a remote control lever, a shift-in operation determination device arranged to determine a shift-in operation based on an output signal of the lever position detection device, an engine output control device arranged to execute an output reduction control to reduce engine output based on a determination result of the shift-in operation determination device, and a shift-in command device arranged to control an engagement of a shift actuator and a dog clutch through a gear in response to a start of the output reduction control.

Accordingly, in a case where the dog clutch is to be engaged with the gear, engine speed can be reduced when it is ascertained that an operator has performed a shift-in operation. Therefore, reduction of engine speed without shift-in can be prevented, and a shock caused during shift-in can be prevented while maintaining the stability of engine output.

In another preferred embodiment of the present invention, the engine output control device is an ignition timing control device arranged to retard ignition timing of the engine.

Accordingly, engine speed can be reduced while restraining extreme reduction of torque, and the shock at a time of shift-in can be prevented while restraining the generation of an engine stall.

In another preferred embodiment of the present invention, the engine output control device terminates the output reduction control when either the shift actuator has completed the engagement or when the remote control lever is returned to a predetermined position.

Accordingly, an excessive deterioration in a combustion state of the engine can be restrained, and engine output after shift-in can be stabilized, even in a case where engine output is reduced at the shift-in time.

In another preferred embodiment of the present invention, the shift-in command device causes the engagement of the shift actuator and the dog clutch with the gear after a lapse of a predetermined time period after the engine output control device starts the output reduction control.

Accordingly, the dog clutch can be engaged with the gear after engine output is certainly reduced, and the shock at a time of shift-in can be effectively prevented, even in a case where there is a delay in actual reduction of engine output after execution of engine output reduction control when shift-in is to be performed.

Another preferred embodiment of the present invention further includes a boat speed determination device arranged to determine a boat speed at a time when the remote control lever is operated, and the engine output control device prohibits the output reduction control when the boat speed determined by the boat speed determination device exceeds a predetermined value.

Accordingly, in a case where the engine suffers from an enormous load, such as when the power transmission of the outboard motor is instantly switched from forward traveling to rearward traveling, a further reduction of engine speed can be prevented, and the shock caused during shift-in can be prevented while preventing an engine stall, engine breakdown, water intrusion due to a counter-rotation of the engine, and so on.

In another preferred embodiment of the present invention, the boat speed determination device estimates the boat speed based on an engine speed and an intake air pressure.

Accordingly, in a case where the boat speed sensor that detects the actual boat speed is not mounted in the boat, engine output can be reduced only when the boat speed is a predetermined value or less, and a shock caused during a time of shift-in can be prevented while preventing an engine stall and/or an engine breakdown.

Another preferred embodiment of the present invention further includes a boat speed communication device arranged to send and receive information of estimated boat speed values between a plurality of outboard motors mounted in the same boat, and the boat speed determination device determines the boat speed based on the highest one of the estimated boat speed values for the respective outboard motors.

Accordingly, even in a case where multiple outboard motors are used and when there is a large rotational speed difference between the respective outboard motors, a high speed state of the boat can be accurately detected. Therefore, even in a case where multiple outboard motors are used, engine output can be reduced only when the boat speed is a predetermined value or less.

As described above, according to the preferred embodiments of present invention, in a case where the dog clutch is to be engaged with the gear, engine speed can be reduced only when it is ascertained that the shift-in will undoubtedly be performed, and the shock caused during the shift-in time can be prevented while maintaining the stability of engine output.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Description will hereinafter be made of the preferred embodiments of a shift motion control device according to the present invention will be described with respect to FIG. 1 through FIG. 6.

Figure 1:
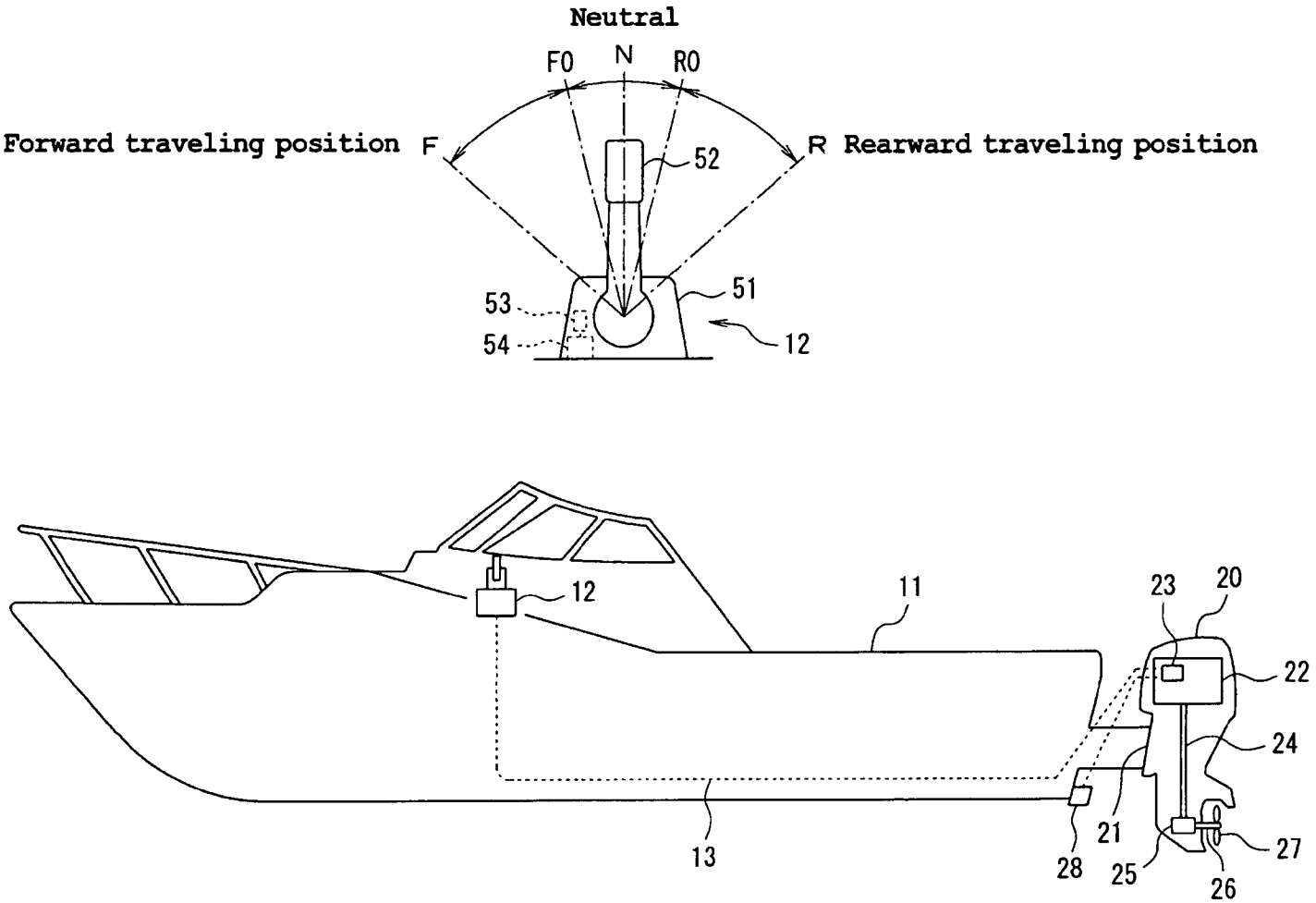
FIG. 1 is a schematic side view showing a boat, to which a shift motion control device is applied, according to a first preferred embodiment of the present invention.

FIG. 1 is a schematic side view showing a boat according to a first preferred embodiment of the present invention in which a shift motion control device is applied.

In FIG. 1, an outboard motor 20 is mounted to the rear of a boat 11 through a bracket 21, and a boat speed sensor 28 that detects the actual boat speed of the boat 11 is disposed at the bottom of the boat 11. Here, an engine 22 is mounted in the outboard motor 20, and preferably arranged in a manner in which its crankshaft is directed in a vertical direction.

The crankshaft of the engine 22 is connected to a drive shaft 24 so that power is transmitted through the drive shaft 24, a gear mechanism 25, and a propeller shaft 26 in this order, to a propeller 27. An ECU (engine control unit) 23 that electrically controls the engine 22 is mounted in the engine 22. A remote control device 12 that outputs an operation command of the shift mechanism is preferably mounted in the driver's seat of the boat 11. The remote control device 12 and the ECU 23 are connected through a communication cable 13.

The communication cable 13 that connects the remote control device 12 and the ECU 23 is preferably a DBWCAN (Drive-By-Wire Controller Area Network) cable. However, the remote control device 12 and the ECU 23 may be connected by other desirable communication method.

The engine 22 is preferably a water-cooled 4-cycle V8 engine. However, any other type of engine could be used, such as a V6 engine or an inline multi-cylinder engine.

A remote control body 51 that is fixed to the boat 11 is disposed in the remote control device 12. A remote control lever 52 is attached to the remote control body 51 so as to be tiltable in the fore and aft directions of the remote control body 51. A lever position sensor 53, which detects the inclination of the remote control lever 52 with respect to the remote control body 51, is disposed in the remote control body 51. Also, an ECU 54, which calculates a target shift position based on the inclination of the remote control lever 52, is disposed in the remote control body 51.

In the remote control device 12, the remote control lever 52 can preferably take the following positions: a neutral position N, with the remote control lever 52 standing upright; a target shift position F0 for traveling forward, with the remote control lever 52 tilted forward by a predetermined angle; a forward traveling position F, with the remote control lever 52 tilted further forward; a target shift position R0 for traveling rearward, with the remote control lever 52 tilted rearward by a predetermined angle; and a rear traveling position R for traveling rearward, with the remote control lever 52 further tilted by a predetermined angle. When the remote control lever 52 reaches the target shift position F0 or the target shift position R0, shift-in operation is determined. And, output of the engine 22 can be increased as the remote control lever 52 is tilted from the target shift position F0 or the target shift position R0 to the forward traveling position F or the rearward traveling position R respectively.

Figure 2:
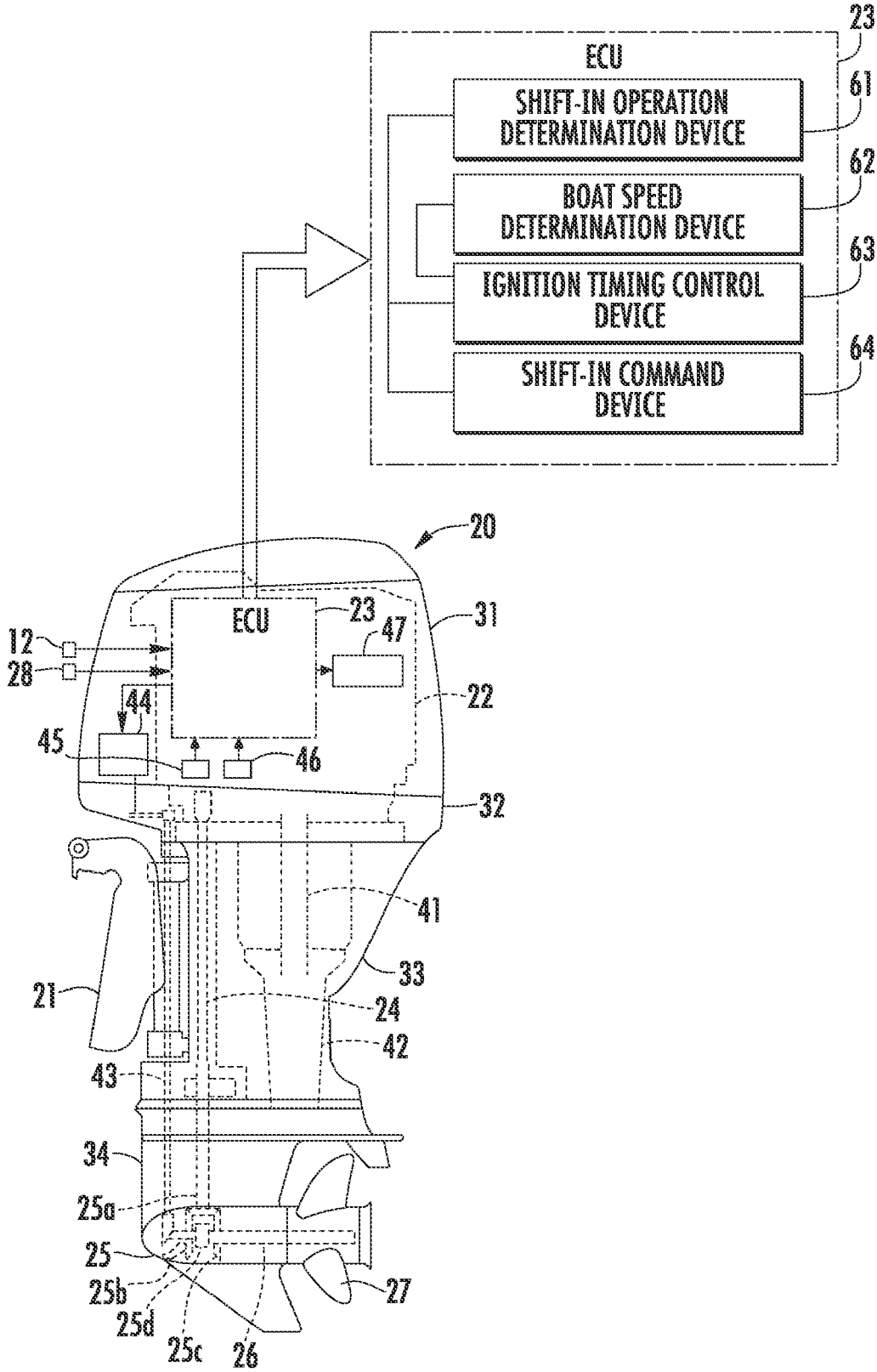
FIG. 2 is a schematic side view showing an outboard motor of FIG. 1.

FIG. 2 is a schematic side view showing the outboard motor of FIG. 1.

In FIG. 2, to the outboard motor 20, an upper cowling 31, a lower cowling 32, an upper casing 33, and a lower casing 34 are disposed in this order from top to bottom. The engine 22 is housed in the upper cowling 31 and the lower cowling 32. An exhaust pipe 41 extending from the engine 22, and an exhaust passage 42 arranged to introduce the exhaust gas exhausted from the exhaust pipe 41, are housed in the upper casing 33. The gear mechanism 25 and the propeller shaft 26 are housed in the lower casing 34. The propeller 27 is mounted to the rear of the lower casing 34.

A drive bevel gear 25*a*, a forward traveling bevel gear 25*b*, a rearward traveling bevel gear 25*c*, and a dog clutch 25*d* are disposed in the gear mechanism 25. The drive bevel gear 25*a* is fixed to the bottom end of the drive shaft 24 so as to rotate along with the rotation of the drive shaft 24. The forward traveling bevel gear 25*b* and the rearward traveling bevel gear 25*c* are arranged on the propeller shaft 26 so as to be rotatable independently of the propeller shaft 26, and engageable with the drive bevel gear 25*a* so as to rotate along with the rotation of the drive shaft 24. The dog clutch 25*d* is arranged on the propeller shaft 26 between the forward traveling bevel gear 25*b* and the rearward traveling bevel gear 25*c* such that the dog clutch 25*d* can slide in an axial direction but cannot rotate in a circumferential direction with respect to the propeller shaft 26.

A shift rod 43, which slides the dog clutch 25*d* in an axial direction on the propeller shaft 26, is disposed in the outboard motor 20. Also, a shift actuator 44, which drives the shift rod 43, is disposed in the outboard motor 20.

In the engine 22 includes, in addition to the ECU 23 that performs electrical control of the engine 22, a rotational speed sensor 45 that detects the rotational speed of the engine 22, an intake air pressure sensor 46 that detects the intake air pressure of the engine 22, and an ignition device 47 that ignites fuel in the engine 22 in accordance with an ignition timing which is commanded by the ECU 23.

The ECU 23 includes a shift-in operation determination device 61 arranged to determine the shift-in operation based on the signal in accordance with the operation of the remote control lever 52; a boat speed determination device 62 arranged to determine the boat speed at the time the remote control lever 52 is operated; an ignition timing control device 63 arranged to retard the ignition timing of the engine 22 based on the determination result of the shift-in operation by the shift-in operation determination device 61; and a shift-in command device 64 arranged to commanding the shift actuator 44 to engage the dog clutch 25*d* with the forward traveling bevel gear 25*b* or the rearward traveling bevel gear 25*c* in a state that the ignition timing of the engine 22 is retarded.

Hereinafter, a description is made of the operation of the shift motion control device.

Figure 3:
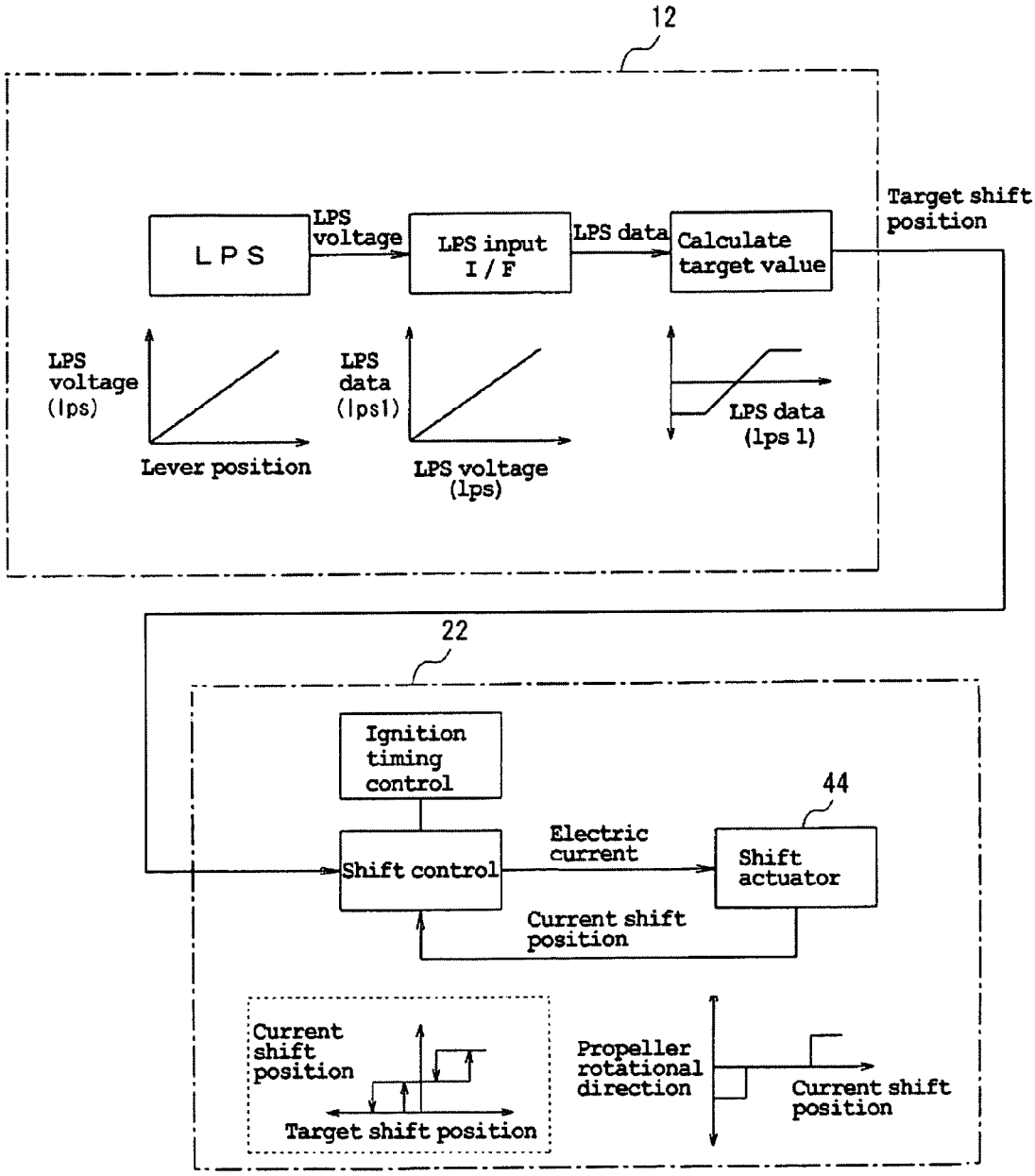
FIG. 3 is a diagram showing the flow of a shift motion control method according to a preferred embodiment of the present invention.
Figure 4:
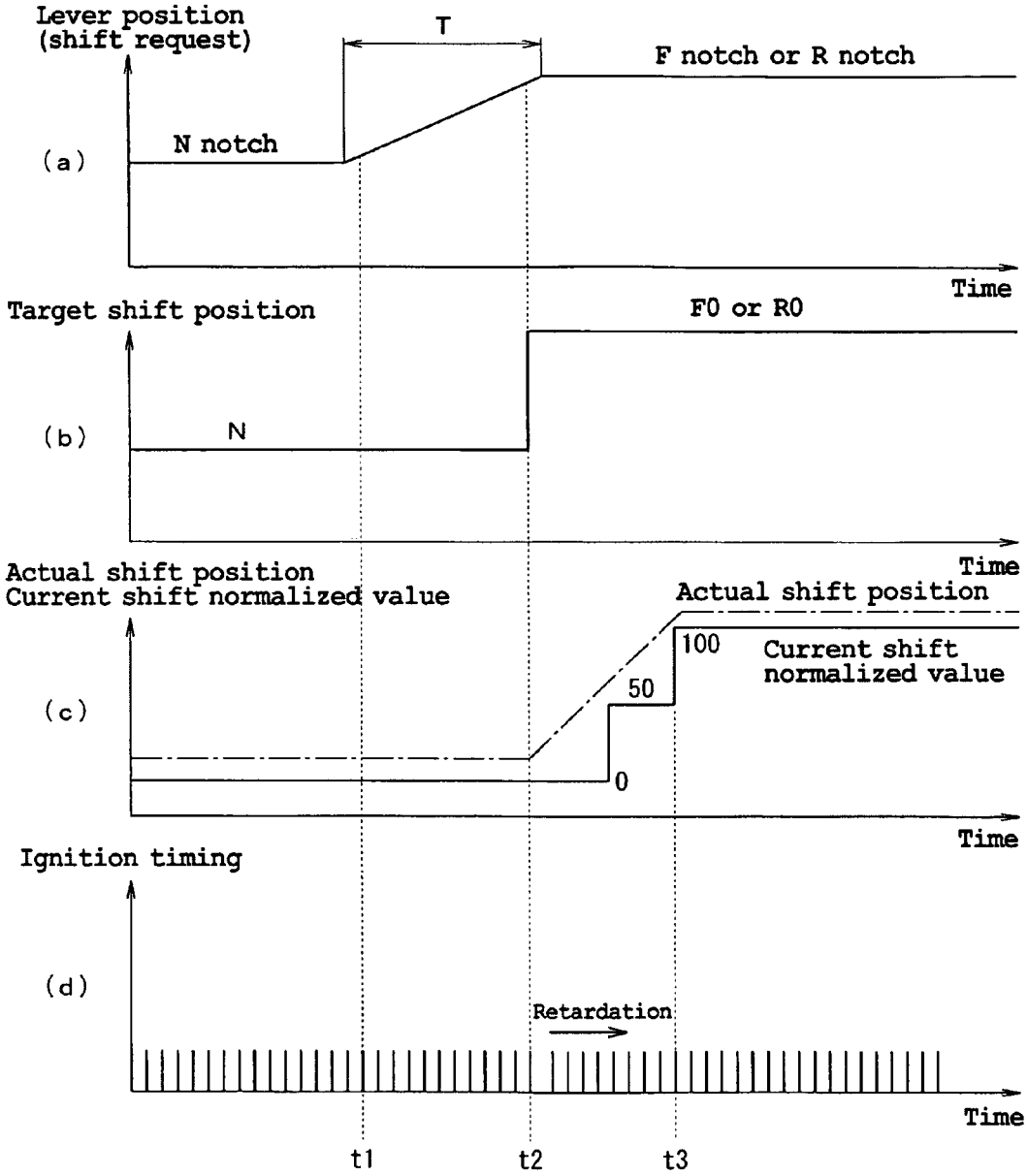
FIG. 4 is a graph showing motion timing of a shift motion control method according to a preferred embodiment of the present invention.
Figure 5:
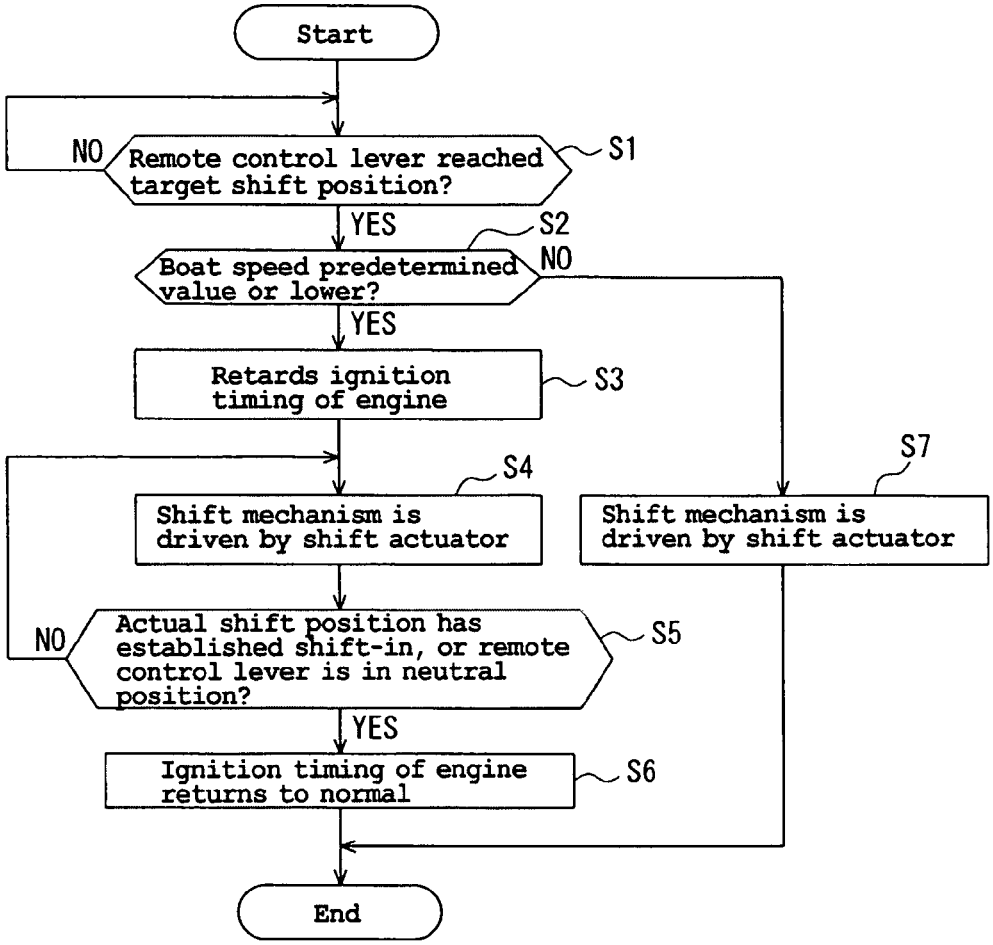
FIG. 5 is a flowchart showing a shift motion control method in accordance with a preferred embodiment of the present invention.

FIG. 3 is a diagram showing the flow of a shift motion control method according to a preferred embodiment of the present invention. FIG. 4 is a graph showing the motion timing of a shift motion control method according to a preferred embodiment of the present invention. FIG. 5 is a flowchart showing a shift motion control method according to a preferred embodiment of the present invention.

In FIG. 3, when the remote control lever 52 of FIG. 1 is tilted from the neutral position N (time t1 in FIG. 4), the lever position sensor 53 outputs the LPS voltage in accordance with the position of the remote control lever 52. The LPS voltage output from the lever position sensor 53 is converted to the LPS data through an LPS input interface. The LPS data is input to the ECU 54, and then target value calculation is performed in the ECU 54. Accordingly, it is determined whether or not the remote control lever 52 reaches the target shift position F0 or reaches the target shift position R0 from the neutral position N (shown in FIG. 4 (*a*) and FIG. 4 (*b*)), and a signal indicating the target shift position is input to the ECU 23 in FIG. 2 (time t2 in FIG. 4). The time T, which is required for the remote control lever 52 to reach the target shift position F0 or the target shift position R0 from the neutral position N, is approximately a few hundred milliseconds under normal conditions.

Actual boat speed detected by the boat speed sensor 28 in FIG. 1, and rotational speed of the engine 22 detected by the rotational speed sensor 45 in FIG. 2, and intake air pressure of the engine 22 detected by the intake air pressure sensor 46, are input to the ECU 23.

When a signal indicating the target shift position is input to the ECU 23, the shift-in operation determination device 61 determines the shift-in operation based on the signal indicating the target shift position (step S1 in FIG. 5). When actual boat speed detected by the boat speed sensor 28 is input to the ECU 23, the boat speed determination device 62 determines the boat speed at the time that the remote control lever 52 is operated. In a case where the boat speed sensor 28 is not mounted in the boat 11, the boat speed determination device 62 may estimate the boat speed based on the rotational speed of the engine 22 detected by the rotational speed sensor 45 and the intake air pressure of the engine 22 detected by the intake air pressure sensor 46.

When the shift-in operation determination device 61 determines that the shift-in operation is performed by using the remote control lever 52, and in a case where the boat speed determined by the boat speed determination device 62 is a predetermined value or less (step S2 in FIG. 5), the ignition timing control device 63 controls the ignition timing of the ignition device 47 so as to retard the ignition timing of the engine 22 (time t2 in FIG. 4, step S3 in FIG. 5).

In accordance with the retardation of ignition timing of the engine 22, the shift-in command device 64 outputs a shift-in command to the shift actuator 44 to engage the dog clutch 25*d* with the forward traveling bevel gear 25*b* or the rearward traveling bevel gear 25*c* (time t2 in FIG. 4, step S4 in FIG. 5).

The shift-in command device 64 may output a shift-in command to the shift actuator 44, after a lapse of a predetermined time period after ignition timing of the engine 22 is retarded. Delay time, which is from the time when the ignition timing of the engine 22 is retarded to the time when the shift-in command is output to the shift-actuator 44, can be set to such a length that output of the engine 22 is reduced without the user feeling the delay, such as about several tens of milliseconds.

When receiving the shift-in command from the shift-in command device 64, the shift actuator 44 drives a shift rod 43 (shown in FIG. 2) to engage the dog clutch 25*d* with either the forward traveling bevel gear 25*b* or the rearward traveling bevel gear 25*c* (time t2 to t3 in FIG. 4). When the dog clutch 25*d* is engaged with the forward traveling bevel gear 25*b* or the rearward traveling bevel gear 25*c*, power of the drive shaft 24 is transmitted to the propeller shaft 26, and the propeller 27 is driven. Accordingly, the boat 11 in FIG. 1 can travel in a forward or rearward direction.

In a case where the actual shift position establishes shift-in as a result of the driving of the shift actuator 44, or in a case where the remote control lever 52 is returned to the neutral position N (step S5 in FIG. 5), the ignition timing control device 63 returns the ignition timing of the engine 22 to normal (time t3 in FIG. 4, step S6 in FIG. 5).

On the other hand, in step S2 in FIG. 5, in a case where the boat speed determined by the boat speed determination device 62 exceeds the predetermined value, the shift-in command device 64 outputs the shift-in command to the shift actuator 44, so that the dog clutch 25*d* is engaged with the forward traveling bevel gear 25*b* or the rearward traveling bevel gear 25*c* without retardation of the ignition timing of the engine 22 (step S7 in FIG. 5).

Accordingly, in a case where the dog clutch 25*d* is to be engaged with the forward traveling bevel gear 25*b* or the rearward traveling bevel gear 25*c*, engine speed can be reduced when it is ascertained that shift-in will undoubtedly be performed. Therefore, reduction of engine speed while not performing shift-in can be prevented, and the shock which occurs during shift-in can be prevented while maintaining the stability of engine output.

In the first preferred embodiment described above, whether the target shift position F0 or R0 is reached or not is determined immediately before the remote control lever 52 reaches the F notch or R notch position (time t2 of FIG. 4). Therefore, motion timing can be set so that shift drive by the shift actuator 44 and retardation control by the ignition timing control device 63 have already been started by the time when the remote control lever 52 reaches the F notch or R notch position.

After the remote control lever 52 reaches the F notch or R notch position, the dog clutch 25*d* is completely engaged with the forward traveling bevel gear 25 or the rearward bevel gear 25*c*, and retardation control by the ignition timing control device 63 can be ended.

Figure 6:
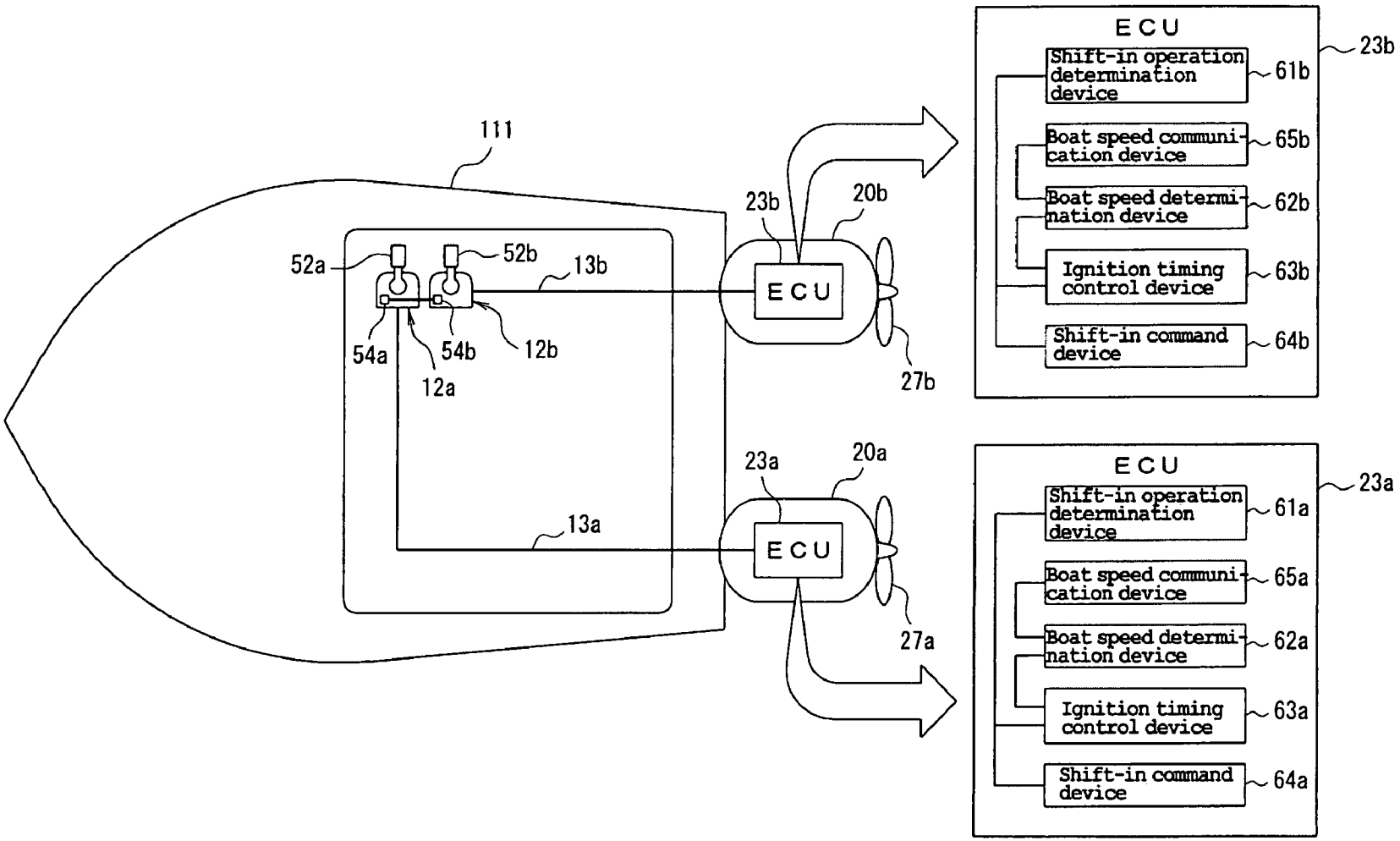
FIG. 6 is a schematic plan view showing a boat, to which a shift motion control device is applied, according to a second preferred embodiment of the present invention.

FIG. 6 is a schematic plan view showing a boat, to which a shift motion control device is applied, according to a second preferred embodiment of the present invention.

In FIG. 6, a plurality of outboard motors 20*a*, 20*b* are mounted to the rear of a boat 111. ECUs 23*a*, 23*b*, which perform electrical control of the engine mounted in the outboard motors 20*a*, 20*b*, are disposed in the outboard motors 20*a*, 20*b*. Propellers 27*a*, 27*b* are disposed to the rear of the outboard motors 20*a*, 20*b* respectively. Remote control devices 12*a*, 12*b*, which correspond to the outboard motors 20*a*, 20*b*, are mounted in the driver's seat of the boat 111. The remote control devices 12*a*, 12*b* and the ECUs 23*a*, 23*b* are connected through communication cables 13*a*, 13*b* respectively.

Remote control levers 52*a*, 52*b*, which perform remote control operation, are disposed in the remote control devices 12*a*, 12*b* respectively. Also, ECUs 54*a*, 54*b*, which calculate the target shift positions based on the inclination of the remote control levers 52*a*, 52*b*, respectively, are disposed in the remote control devices 12*a*, 12*b*. The ECU 54*a* and ECU 54*b* are connected so that they can communicate with each other.

The ECUs 23*a*, 23*b* respectively include: shift-in operation determination devices 61*a*, 61*b* that respectively determine shift-in operation based on the signal corresponding to the operation of the remote control levers 52*a*, 52*b*; boat speed determination devices 62*a*, 62*b* that respectively determine the boat speed at the time the remote control levers 52*a*, 52*b* are operated; ignition timing control devices 63*a*, 63*b* that respectively retard the ignition timing of the engine based on the determination result of the shift-in operation by the shift-in operation devices 61*a*, 61*b*; shift-in command devices 64*a*, 64*b* that respectively command the shift actuator to engage the dog clutch with the forward traveling bevel gear or the rearward traveling bevel gear in a state where the ignition timing of the engine is retarded; and boat speed communication devices 65*a*, 65*b* that respectively send or receive the boat speed estimation value between the outboard motors 20*a*, 20*b* mounted in the boat 111.

The boat speed communication devices 65*a*, 65*b* send or receive the boat speed estimation value between the outboard motors 20*a* and 20*b*. The boat speed determination devices 62*a*, 62*b* determine the boat speed at the time that the remote control levers 52*a*, 52*b* are operated based on the highest boat speed estimation value estimated in the respective outboard motors 20*a*, 20*b*.

When the shift-in operation determination devices 61*a*, 61*b* respectively determine that shift-in is established by the remote control levers 52*a*, 52*b*, and in a case where the boat speed determined in the respective boat speed determination devices 62*a*, 62*b* is a predetermined value or less, the ignition timing control devices 63*a*, 63*b* control the ignition timing so as to retard the ignition timing of the engine. In accordance with retardation of ignition timing of the engine, the respective shift-in command devices 64*a*, 64*b* output the shift-in command to the shift actuator to engage the dog clutch with the forward traveling bevel gear or the rearward traveling bevel gear.

Accordingly, even in a case where multiple outboard motors are used and when rotational speed difference between the respective outboard motors 20*a*, 20*b* is large, a high speed state of the boat can be easily and accurately detected. Therefore, even in a case where multiple outboard motors are used, engine output can be reduced only when the boat speed is a predetermined value or less.

In the preferred embodiment of FIG. 6, description is made based on an example in which the two outboard motors 20*a*, 20*b* are mounted in the boat 111. However, the present invention can also be applied to the case where three or more outboard motors are mounted in the boat 111.

In the preferred embodiments described above, a method of retarding the ignition timing of the engine 22 is explained for a purpose of reducing the output of the engine 22 at the time of shift-in. However, the present invention is not limited to implementation by retarding the ignition timing of the engine 22, and may be implemented by: stopping ignition for a short period of time; reducing a number of ignitions; stopping fuel injection from an injector; and reducing fuel injections from the injector.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A shift motion control device comprising:

a lever position detection device arranged to detect a position of a remote control lever;

a shift-in operation determination device arranged to determine a shift-in operation based on an output signal of the lever position detection device;

an engine output control device arranged to execute an output reduction control to reduce an engine output based on a determination result of the shift-in operation determination device; and a shift-in command device arranged to control an engagement between a shift actuator and a dog clutch through a gear during a start of the output reduction control.

2. The shift motion control device according to claim 1, wherein the engine output control device is an ignition timing control device arranged to retard an ignition timing of the engine.

3. The shift motion control device according to claim 1, wherein the engine output control device ends the output reduction control when the shift actuator has either completed the engagement, or when the remote control lever is returned to a predetermined position.

4. The shift motion control device according to claim 2, wherein the engine output control device ends the output reduction control when the shift actuator has either completed the engagement, or when the remote control lever is returned to a predetermined position.

5. The shift motion control device according to claim 1, wherein the shift-in command device engages the shift actuator and the dog clutch with the gear after a lapse of a predetermined time period which occurs after the engine output control device starts the output reduction control.

6. The shift motion control device according to claim 2, wherein the shift-in command device engages the shift actuator and the dog clutch with the gear after a lapse of a predetermined time period which occurs after the engine output control device starts the output reduction control.

7. The shift motion control device according to claim 3, wherein the shift-in command device engages the shift actuator and the dog clutch with the gear after a lapse of a predetermined time period which occurs after the engine output control device starts the output reduction control.

8. The shift motion control device according to claim 4, wherein the shift-in command device engages the shift actuator and the dog clutch with the gear after a lapse of a predetermined time period which occurs after the engine output control device starts the output reduction control.

9. The shift motion control device according to claim 1, further comprising:

a boat speed determination device arranged to determine a boat speed at a time when the remote control lever is operated; wherein the engine output control device prohibits the output reduction control when the boat speed determined by the boat speed determination device exceeds a predetermined value.

10. The shift motion control device according to claim 9, wherein the boat speed determination device estimates the boat speed based on an engine speed and an intake air pressure.

11. The shift motion control device according to claim 10, further comprising:

a boat speed communication device arranged to send and receive information of estimated boat speed values between a plurality of outboard motors mounted in the same boat; wherein the boat speed determination device determines the boat speed based on the highest one of the estimated boat speed values for each of the respective outboard motors.

* * * * *